United States Patent [19]

Cate et al.

[11] Patent Number: 4,975,019

[45] Date of Patent: Dec. 4, 1990

[54] RUBBISH COLLECTING SYSTEM

[76] Inventors: Timothy R. Cate, 62 Bachelder Rd, R.F.D., Raymond, N.H. 03077; Roy Porter, Mount Delight Rd., Deerfield, N.H. 03037

[21] Appl. No.: 345,419

[22] Filed: May 1, 1989

[51] Int. Cl.[5] ..... B65F 3/00; B65D 1/24

[52] U.S. Cl. ..... 414/786; 414/494; 414/500; 220/1 T; 220/4 D; 220/23.4; 220/23.83

[58] Field of Search ..... 414/469, 471, 482, 483, 414/491, 494, 498, 500, 786; 220/1 T, 23.4, 23.83, 4 C, 4 D

[56] References Cited

U.S. PATENT DOCUMENTS

| | | | |
|---|---|---|---|
| 3,071,264 | 1/1963 | Totaro et al. | 414/494 |
| 3,168,959 | 2/1965 | Chandler et al. | 414/500 |
| 3,643,993 | 2/1972 | Asadurian | 220/1 T X |
| 3,841,505 | 10/1974 | Kent | 414/500 X |
| 4,126,241 | 11/1978 | Klosk | 220/1 T X |
| 4,801,034 | 1/1989 | Sandomeno | 220/1 T X |
| 4,821,903 | 4/1989 | Hayes | 220/1 T |
| 4,834,262 | 5/1989 | Reed | 220/1 T X |
| 4,919,290 | 4/1990 | Wadel | 220/1 T |

FOREIGN PATENT DOCUMENTS

| | | | |
|---|---|---|---|
| 3403824 | 8/1985 | Fed. Rep. of Germany | 220/1 T |
| 3501626 | 7/1986 | Fed. Rep. of Germany | 220/1 T |
| 3506530 | 8/1986 | Fed. Rep. of Germany | 220/1 T |
| 3608031 | 10/1986 | Fed. Rep. of Germany | 220/1 T |
| 3542252 | 5/1987 | Fed. Rep. of Germany | 220/1 T |
| 3625995 | 2/1988 | Fed. Rep. of Germany | 220/1T |
| 1408934 | 7/1965 | France | 414/494 |
| 2207339 | 2/1989 | United Kingdom | 220/1 T |

*Primary Examiner*—Frank E. Werner
*Assistant Examiner*—Robert S. Katz

[57] ABSTRACT

A rubbish segregating and collection system makes use of a transporter that is placed at a town dump. The transporter has several containers to receive different classes of rubbish, each of which containers is removable from the transporter. When filled, the transporter is placed on a carrier and replaced with another transporter. The filled transporter is carried to a central collection and segregation facility where the individual containers tare weights may be determined following which their contents are dumped and inspected as necessary. The segregated rubbish is then transported to the appropriate reclamation centers for each class of rubbish. The preferred type of bottom jaw-like opening individual container is also claimed.

8 Claims, 1 Drawing Sheet

RUBBISH COLLECTING SYSTEM

The present invention pertains to a rubbish segregating and collection system. In particular it pertains to a multi-recyclable products transporter having containers each of which receives a designated type of rubbish, which transporter can readily be retrieved from a collection area and taken to a central location for unloading, such a multi-material receiving facility (MMRF).

BACKGROUND

Until recently, most of a community's trash and rubbish have gone into a landfill. However, it has been determined that landfills can severely contaminate the environment and they can be expensive to obtain and maintain. Many of them are unline and leak toxic organics into the soil and undergrond water systems. Many landfills are running out of room. It is estimated that more than 400,000 tons of garbage and rubbish are generated each day in the United. States—160,000,000 tons a year, and the amounts of such garbage and rubbish is growing each year.

Waste disposal used to be primarily a local issue. It is now, however, fast become a matter of regional, State and even national concern. Communities everywhere ae scrambling for ways to clean up and dispose of their trash and rubbish.

It has been said that approximately 3.5 lbs of trash are generated each day for each person. This is made up of approximately 36% paper, 11% glass, 11% yard waste, 12% iron, steel and other ferrous metals, 14% food waste, 6% plastic and 10% other organic and non-organic substances. More and more packaging is finding its way into trash while the amount of organic materials is decreasing. In the Northeast, about 650 lbs of packaging are thrown away per individual every year.

Considerable emphasis is now being given to reducing the amount of rubbish that is generated. It is of course impossible to eliminate rubbish entirely. Of the rubbish that must be disposed of, recycling or recovering marketable materials for reuse is considered a highly desirable object. It reduces the amount of waste that has to go into landfill; it gives reusable materials a second life; it saves energy and it may even generate revenue—cash for trash—for a community. It can cost a community $30 to $120 per ton for land fill disposal.

To effectuate recycling it is most desirable to segregate the rubbish as it is being collected, requiring each person depositing his or her rubbish to separate it into appropriate categories such as cardboard, newspaper, aluminum cans, glass of different colors, tin cans and plastics. Various ways have been developed by communities to facilitate this required segregation. Most have created bins for the different categories, and when the bins are filled, have a collection service come in which a truck and a loader of some sort for emptying the bins. This is not very efficient. Also, the communities are required to build and maintain the collection bins and to provide adequate supervision to assure as much as possible that each class of rubbish is placed in its designated bin and that there is co-mingling or contamination. It may cost as much as $45,000.00 to 90,000.00 for a small to medium sized town to build collection bins and have on hand equipment to service them.

The present invention is addressed to this segregating and collection problem.

THIS INVENTION

The present invention proposes to provide a transporter that can be carried on a carrier and left at a collection site for accomplishing the segregation and collection of rubbish. The transporter has bins and compartments to receive various classes of rubbish, appropriately sized so that they will fill up at approximately the same rate. When the transporter is filled up, it is taken by the carrier—a truck—over the highway to a central collection point or MMRF where the classified rubbish in each container can be dumped, weighed, processed as required and from there taken to the reclamation plants for each type of rubbish.

The system of the present invention thus alleviates the need of a community to build its own segregation bins and permits the community to maintain a neat, sanitary and attractive collection area. The accounting to the community for each class of rubbish collected is greatly simplified as the tare weight of each container or compartment can readily ascertained at the MMRF. This can be of some importance. For example, a ton of aluminum cans is at present (1989) valued at approximately $1,000.

In this connection, the value of some of the rubbish collected, such as aluminum cans, may be such as to require measures to be taken to prevent theft of the rubbish. In the present system, each container receiving a class of rubbish is enclosed and, if necessary, can be secured as with a lock to prevent opening. If a mailbox type of inlet is provided, then it is pretty difficult for a thief to open or enter the container to remove the contents.

In brief compass, the present invention is a rubbish segregating and collecting system and equipment therefor. This system comprises providing at a community collection site a transporter. The transporter is quite large being at least 20' long and 6 to 10 feet high. Its size is such that it can be transported over the highway. Generally this means it will not be wider than 12 feet, usually no wider than 9 feet, although it could be as long as 40 to 50 feet.

Preferably, the transporter has an enclosed area to receive bulky flattened cardboard. It has open shelves for receiving and holding a series of containers. Each container is designated to receive a particular class or type of rubbish. Generally there will be at least four containers and usually there will be 7 or 8 of them. The containers can have different sizes but generally they will be at least 4 feet high, 2.5 feet wide and 3.5 feet deep. Preferably they will hold in the range of 3 to 6 cubic yards. They have openings for the insertion of the different classes of rubbish, and if the rubbish has value, the opening can be of the mailbox type that frustrates the removal of the rubbish once inserted. The containers can be as much as 6 to 10 feet high but as the openings for insertion of rubbish are at the top, if they are too high it is difficult for people to insert their rubbish unless a special walkway is provided. The openings in the cardboard receiving bin are thin, permitting the insertion of flattened cardboard while frustrating the insertion of whole cardboard boxes or of bagged waste.

As persons bring their rubbish to the collection site, they insert the designated class of rubbish in each of the containers on the transporter. Thereafter, the transporter is loaded onto a carrier and conveyed to an unloading site with an equivalent unit having been left at the collection site to repeat the cycle.

The carrier for the transporter in one embodiment is a flat bed truck having a track that can pivot from the horizontal to permit the transporter to be pulled up onto the track. The transporter has wheels on its bottom that engage and ride up on the track. The track is preferably hydraulically operated and there is a winch at the forward end of the track with a cable to pull the transporter up on to the track in a known manner.

The relatively small individual containers of this invention carried by the transporter are preferably latched bottom opening to permit dumping of the contents when lifted by a fork of chain lift. Preferably the bottom is hinged at one end and has side rails or walls to serve as a chute directing the contents being discharged in one direction. The bottom is hinged preferably at the end facing the fork lift so that the contents are discharged in the opposite direction away from the fork lift.

The small, 3 to 6 cubic yard, containers of this invention allow dumping versatility, i.e. they can be dumped onto a conveyer, lifted and dumped into a silo or set aside for a few days, then emptied. They also offer another advantage. When towns construct bins, they usually are built to hold 30 to 90 cubic yards. If a contamination problem is occurring, it is not immediately discovered. The small, individual containers used in the present invention when dumped and inspected at the MMRF permit a contamination problem to be quickly uncovered as the containers are collected and rotated over short periods of time. Thus corrective action can be taken before undue amounts of contamination have taken place.

The transporter of this invention has the additional advantage that the containers and compartments can be conveniently, and attractively, color coded, e.g. white for clear glass, green for green glass, brown for amber glass, white (perhaps with a "newspaper" logic) for newspaper, tan for cardboard, silver/white for ferrous cans, blue/orange/white for plastics, silver for aluminum, and so forth.

The preferred procedure at the MMRF is to weigh the contents of each container to generate a waste slip to provide the originating town with a record of the amount collected and then to dump the contents on to a conveyer where any contaminantes are removed by hand or other means. The conveyers then unload into the appropriate processing machinery, e.g. a bailer for metal cans, a cracker for glass or a shredder for plastic. Each class of rubbish is thereafter transported by truck to the appropriate central processing facility or mill for that class. The cardboard usually is dumped out into a floor, inspected and then bailed into 1000 pounded bails.

At present, with the present invention, the sale of the sorted and collected material just about pays for the collection and processing costs. This does, however, permit a community to have its rubbish removed at no cost to the community, to avoid the cost of paying for landfill dumping of the rubbish disposed of by the present system and to avoid the need to installing, equipping and maintaining collecting bins.

THE DRAWING

Referring to the drawings.

DESCRIPTION

Figure 1:
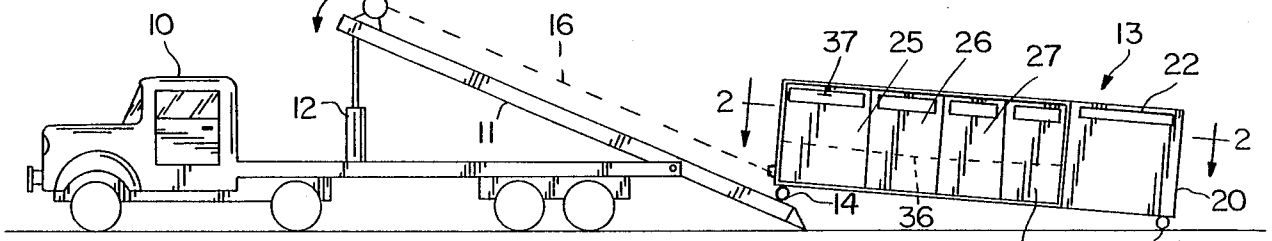
FIG. 1 depicts the three major elements of this invention—a carrier or truck, the transporter and the bins for each class of rubbish carried on the transporter.

Referring to FIG. 1, illustrated is an over the highway carrier or truck 10 having on its bed a track 11 which can be pivoted or raised by a hydraulic means 12 to lower the rear end of the track to the ground to permit the transporter of this invention to be picked up or unloaded. The transporter is shown at 13. It has wheels 14 that ride up on track 11.

The transporter is pulled up on or let down from the track 11 by means of a winch 15 and cable 16 system.

Figure 2:
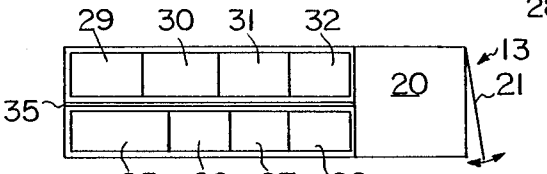
FIG. 2 is a plan view of the transporter shown on FIG. 1 taken along the line of A—A.

Turning now to FIGS. 1 and 2, the transporter 13 is a box like structure that has at one end an enclosed chamber 20 to receive cardboard. At the end of container 20 is a door or gate 21 that can be opened to permit discharge of the collected cardboard. Flattened cardboard is inserted into chamber 20 through opening 22. Opensing 22 is sized to receive the flattened cardboard and to discourage the insertion of uncollapsed boxes or bagged garbage.

The remainder of transporter 13 is open shelves holding a series of containers 25, 26, 27, and 28 on one side and 29, 30, 31, and 32 on the other side. While transporter 13 is shown as having a dividing central longitudinal wall 35 to provide for containers on either side of the transporter, the preferred arrangment, there could well be no dividing wall and one container could reach from one side of the transporter to the other.

The containers can be secured on the transporter by any convenient means. For example, a chain 36 can be strung across the face of the containers and if necessary may be otherwise locked or secured to prevent the unauthorized removal of the containers.

Most of the containers have an opening in the front wall at the top as illustrated to receive the designated class of rubbish. However, as indicated previously, if the collected rubbish has value, such as aluminum cans or other non-ferrous metals, then a mailbox type of door 37 as shown for container 25 can be used.

As an example, the different compartments shown in FIG. 2 could be designated as follows:

25. Aluminum Cans
26. Plastic
27. Tin Cans or ferrous metal
28. Newspapers
29. Automobile Tires
30. Brown Glass
31. Green Glass
32. Clear Glass The transporter may or may not have a roof that extends over the shelf area. It is preferred that it have such a roof as this is structurally stronger.

Figure 3:
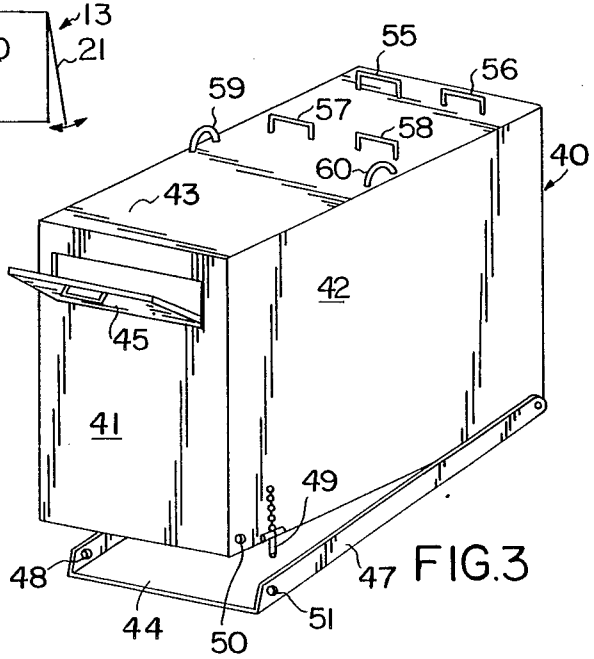
FIG. 3 is a perspective view of one type of a bottom unloading container or bin that can be used in the practice of this invention.

FIG. 3 illustrates one type of container 40 that can be used in connection with the transporter of this invention. It is simply an enclosed box having flat front 41 and back (not shown), sides 42, top 43, and bottom 44 walls. The container illustrated has a mailbox or pivoting type of door 44, to permit insertion of rubbish. By "mailbox" type of door is meant a door in a side opening of container 40 hinged at the bottom of the opening whereby the top of the door can open outwardly and downwardly thereby exposing the opening and providing a shelf as illustrated in FIG. 3.

While various methods can be provided for the unloading of the container, for example, the back can be hinged to drop down, the unloading method illustrated is preferred. In this method, the bottom of the container is pivoted at one end to open in a jaw like fashion as illustrated to permit the contents to discharge with the bottom serving as a chute directing the discharge rather than having the discharge fall generally around underneath the container. To this end, the bottom has side walls 47 and 48. The bottom may be secured against opening by any convenient latch means. As illustrated, a simple pin 49 matcing with holes 50 and 51 is used to secure the bottom. There is a like pin on the other side of the container.

Container 40 is supplied with lugs to permit the container to be removed and replaced on transporter 40 with either a forklift or a chain lift. To this end, brackets 55, 56, 57, 58, to receive forklift prongs are welded on the top of the counter as well as handles 59, 60 to receive chain hooks. It will be appreciated that if the container is lifted up by brackets 55, 56, 57, 58 with a fork lift, then with removal of pins 49 from either side of the container, the bottom will drop open and the contents will flow out, after which the bottom 44 can be closed and repinned.

Figure 4:
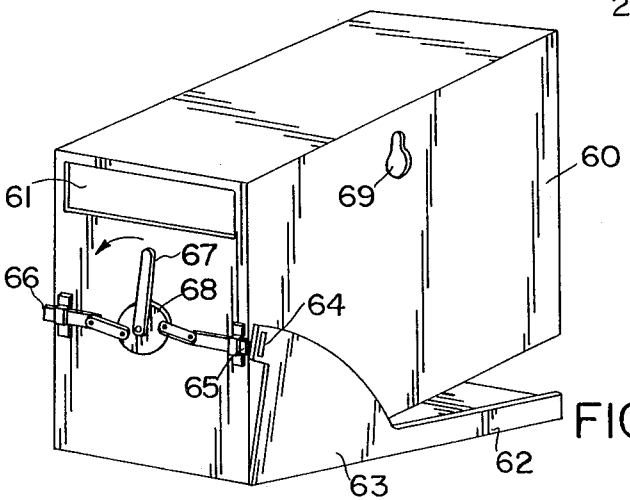
FIG. 4 is a perspective view of another bottom embodying container showing a different latching mechanism.

Illustrated in FIG. 4 is a container 60 similar to that of FIG. 3 except that the container has a simple rectangular opening 61 at the top on the same side as the bottom 62 is hinged. A different latching mechanism is illustrated. The bottom 62 has on each side at the hinged end a quarter-circle tab having a slot 64 to receive latch 65 (66 on opposite side). The latches are operated by handle 67 rotating the opening/closing mechanism 68 in a known manner. The container may have slots 69 on either side to receive chain hooks.

With the embodiment shown in FIG. 4 the forks of a fork lift can be inserted in opening 61 to lift and move the container. The fork lift operator can then operator handle 67 to drop bottom 62 allowing the contents to be directionally discharged away from the fork lift into a receiving silo or onto a conveyor.

The transporter will carrying containers of various sizes to accommodate the amount of each class of rubbish expected to be collected each cycle. Generally speaking, each container will be at least 4 feet high, 2.5 feet wide and 3.5 feet deep if containers are carried on each side of the transporter. Any one container could be as much as 6 to 10 feet high, 5 or 6 feet wide, and 9 feet deep if it were designated for a relatively light material such as aluminum cans. Preferably each container will have a capacity of at least 3 to 6 cubic yards. The cardboard collection portion of the transporter 20 may have a volume of preferably 10 to 30 cubic yards.

The transporter and its containers will be of rugged construction, usually of welded, bolted or riveted steel or aluminum plate. If some containers are to receive corrosive materials such as batteries, then they may be plastic lined or made entirely of plastic. Rugged construction is of course essential as the transporter and the containers will be subject to much hard usage.

Having described this invention, what is sought to be protected by Letters Patent is simply set forth in the following claims:

1. A method of segregating and collecting rubbish comprising the steps of:

(a) Providing at a collection site a transporter, said transporter:

(1) having a platform with a fixed enclosed area at one end thereof to receive flattened cardboard;

(2) the balance of said platform being an open shelf for receiving and holding separable containers, and (3) including at least 4 separable containers removably placed on said shelf, said containers being at least 4 feet high, 2.5 feet wide, and 3.5 feet deep and being designated and having openings for insertion of different classes of rubbish;

(b) placing rubbish in said containers and said enclosed area in accordance with the designations for each; and (c) thereafter removing and transporting said transporter along with said containers as a unit to an unloading site while leaving an equivalent unit at said collection site to repeate the cycle.

2. The method of claim 1 wherein said transporter is at least 20 feet long and no more than 9 feet wide and 10 feet high and providing at least 6 of said containers therein, each of which has a capacity in the range of 3 to 6 cubic yards.

3. The method of claim 1 wherein one of said containers is designated to receive aluminum cans, is enclosed, can be secured and has a mail box type opening to receive cans while preventing the unauthorized removal of cans from the container, and allowing only aluminum cans to be placed therein.

4. The method of claim 1 wherein said enclosed area to receive flattened cardboard has a slot near the top thereof and a closeable discharge door for removing cardboard, said slot being of a size to frustrate the insertion of boxes not flattened and of bagged waste, and removing cardboard therefrom at said unloading site through said discharge door.

5. The method of claim 1 wherein said containers have handling means thereon permitting insertion and removal from said transporter by a forklift or by a chain lift, and so removing said containers at said unloading site.

6. The method of claim 5 wherein said containers have a latched bottom opening to permit dumping of the contents, and for dumping said containers at said unloading site.

7. The method of claim 2 further comprising designating each of said containers to receive one of the following:

green glass, amber glass, clear glass, newspaper, plastics or aluminum cans.

8. The method of claim 7 comprising placing and designating additional containers on said shelf to receive ferrous metal and automobile tires.

* * * * *